US007416647B2

(12) United States Patent
Yamamuro

(10) Patent No.: US 7,416,647 B2
(45) Date of Patent: Aug. 26, 2008

(54) PLATING PROCESSING DEVICE

(75) Inventor: Eiichi Yamamuro, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 443 days.

(21) Appl. No.: 10/834,883

(22) Filed: Apr. 30, 2004

(65) Prior Publication Data

US 2004/0226816 A1 Nov. 18, 2004

(30) Foreign Application Priority Data

May 13, 2003 (JP) ..... 2003-134054

(51) Int. Cl.
*C25D 17/22* (2006.01)
*C25D 17/00* (2006.01)
*B08B 3/02* (2006.01)

(52) U.S. Cl. ..... 204/275.1; 204/224 R; 204/234; 204/237; 134/151; 134/175

(58) Field of Classification Search ..... 204/224 R, 204/224 M, 237, 239, 241, 275.1, 234; 134/151, 134/175

See application file for complete search history.

(56) References Cited

U.S. PATENT DOCUMENTS 4,545,885 A * 10/1985 Hori et al. ..... 204/207
6,858,084 B2 * 2/2005 Inoue et al. ..... 118/666

FOREIGN PATENT DOCUMENTS

JP 03-044479 * 2/1991
JP 11-092949 4/1999
JP 2001-316878 11/2001

* cited by examiner

*Primary Examiner*—Roy King
*Assistant Examiner*—Lois L. Zheng
(74) *Attorney, Agent, or Firm*—Staas & Halsey LLP

(57) ABSTRACT

A plating processing device comprises: a plating bath, on which an object to be plated is mounted; and a sparger provided with plating nozzle and washing nozzle for jetting plating solution and washing solution, respectively, toward the object in such a manner that the used plating solution and washing solution are accumulated and collected in the plating bath. Plating solution is supplied to the plating nozzle from a plating solution tank. Washing solution is supplied to the washing nozzle from a washing solution tank. The used plating solution and washing solution are accumulated in the plating bath, are recovered to the plating solution tank and used again as a plating solution.

6 Claims, 3 Drawing Sheets

PLATING PROCESSING DEVICE

BACKGROUND OF THE INVENTION

1. Field of the Invention

The present invention relates to a plating processing device. More particularly, the present invention relates to a plating processing device used for manufacturing electronic parts such as lead frames, semiconductor wafers and so forth.

2. Description of the Related Art

There is provided a plating process such as a gold plating process in which an inner lead of a lead frame or a terminal of a wiring board is plated with gold in the process of manufacturing a semiconductor device. Various plating methods are used in the plating process. For example, in the case of partially plating an object to be plated such as a lead frame, the lead frame is interposed between masks used for plating, and a plating solution is jetted out into a plating region of the object that is exposed from the masks so as to conduct plating on the object to be plated.

After the completion of plating, the object which has been plated is dipped in a recovery tank to recover plating components so that a plating solution adhering to the object can be removed. Next, the plating solution adhering to the surface of the object is washed away in a washing tank.

In the plating process in which electronic parts such as lead frames are plated, an expensive plating solution such as a gold plating solution is used in some cases. Therefore, it is effective to recover and recycle the plating solution. Further, it is necessary to wash the object after the completion of plating in order to prevent the plating solution remaining on the object from exerting a bad influence on a product.

Concerning the method of washing the object to be plated, the following methods are used. One method is described as follows. After a plating solution has been jetted out to a semiconductor wafer in the process of manufacturing the semiconductor wafer, pure water is jetted out from the plating solution jetting nozzle to the semiconductor wafer so as to wash the semiconductor wafer. Another method is described as follows. Nozzles for jetting pure water are arranged in the outer plating bath so as to wash the object to be plated. After washing, a waste solution is made to flow into the inner bathing bath or the outer plating bath. These methods are disclosed in the official gazettes of Japanese Unexamined Patent Publication Nos. 11-92949 and 2001-316878.

However, according to the above method in which the plating solution is recovered into the recovery tank, the cost for recovery is increased. The reasons are described as follows. In order to easily remove the plating solution from the object, pure water is stored in the recovery tank so as to recover the plating solution. Therefore, in order to recycle the solution in the recovery tank as a plating solution, it is necessary to concentrate the solution to a predetermined concentration. Therefore, it is necessary to provide a device for concentrating the solution, and the manufacturing cost for concentration is required. Further, when the recovery tank is continuously used, the concentration of the solution in the recovery tank is increased, and the recovering capacity is lowered. Accordingly, it is necessary to periodically adjust the concentration of the solution in the recovery tank.

SUMMARY OF THE INVENTION

The present invention has been accomplished to solve the above problems of the prior art. It is an object of the present invention to provide a plating processing device characterized in that: after the completion of plating an object to be plated, the object which has been plated can be effectively and positively washed so as to prevent the plating solution, which remains on the object to be plate, from exerting a bad influence on a product; and the plating solution is easily recovered so that the plating solution can be effectively recovered and recycled.

According to the present invention, there is provided a plating processing device comprising: a plating bath, on which an object to be plated is mounted; a sparger provided with plating nozzle and washing nozzle for jetting plating solution and washing solution, respectively, toward the object in such a manner that the used plating solution and washing solution are accumulated collected in the plating bath; means for supplying plating solution to the plating nozzle from a plating solution tank; means for supplying washing solution to the washing nozzle from a washing solution tank; and means for recovering the used plating solution and washing solution are accumulated in the plating bath to the plating solution tank.

The sparger comprises: a nozzle plate for supporting the plating nozzle and washing nozzle; a plating solution box attached to the nozzle plate at a side opposite thereof to the object, the plating solution box being communicated with the plating solution supplying means; the nozzle plate provided with first passage connected at one end thereof to the plating nozzle and opened at the other end thereof to inside of the plating solution box, and second passage, independent from the first passage, connected at one end thereof to the washing nozzle and at the other end thereof communicated with the washing solution supplying means.

The object to be plated is mounted on the plating bath via a mask having a plurality of openings which define plating sections on a surface of the object to be plated. In this case, the sparger comprises: a nozzle plate for supporting a plurality of plating nozzles and washing nozzles, which are divided into a plurality of groups for the respective plating sections, each ground comprising a plurality of plating nozzles and at least one washing nozzle; a plating solution box attached to the nozzle plate at a side opposite thereof to the object, the plating solution box being communicated with the plating solution supplying means; the nozzle plate provided with first passages each connected at one end thereof to the respective plating nozzle and opened at the other end thereof to inside of the plating solution box, and second passages, independent from the first passages, each connected at one end thereof to the washing nozzle and at the other end thereof communicated with the washing solution supplying means.

In each group, there are at least one washing nozzle and a plurality of plating nozzles arranged dispersedly around the washing nozzle so as to uniformly jet the plating solution toward an area within the respective plating section.

The plating solution tank is provided with a heating means for heating the plating solution contained in the plating solution tank to promote an evaporation of the plating solution.

The plating solution tank is provided with an adjusting means for adjusting a concentration of the plating solution contained in the plating solution tank. The adjusting means for adjusting a concentration of the plating solution is a lid, which is detachable with respect to the plating solution tank.

DETAILED DESCRIPTION OF THE PREFERRED EMBODIMENTS

Referring to the accompanying drawings, some preferred embodiments of the present invention will be explained in detail below.

Figure 1:
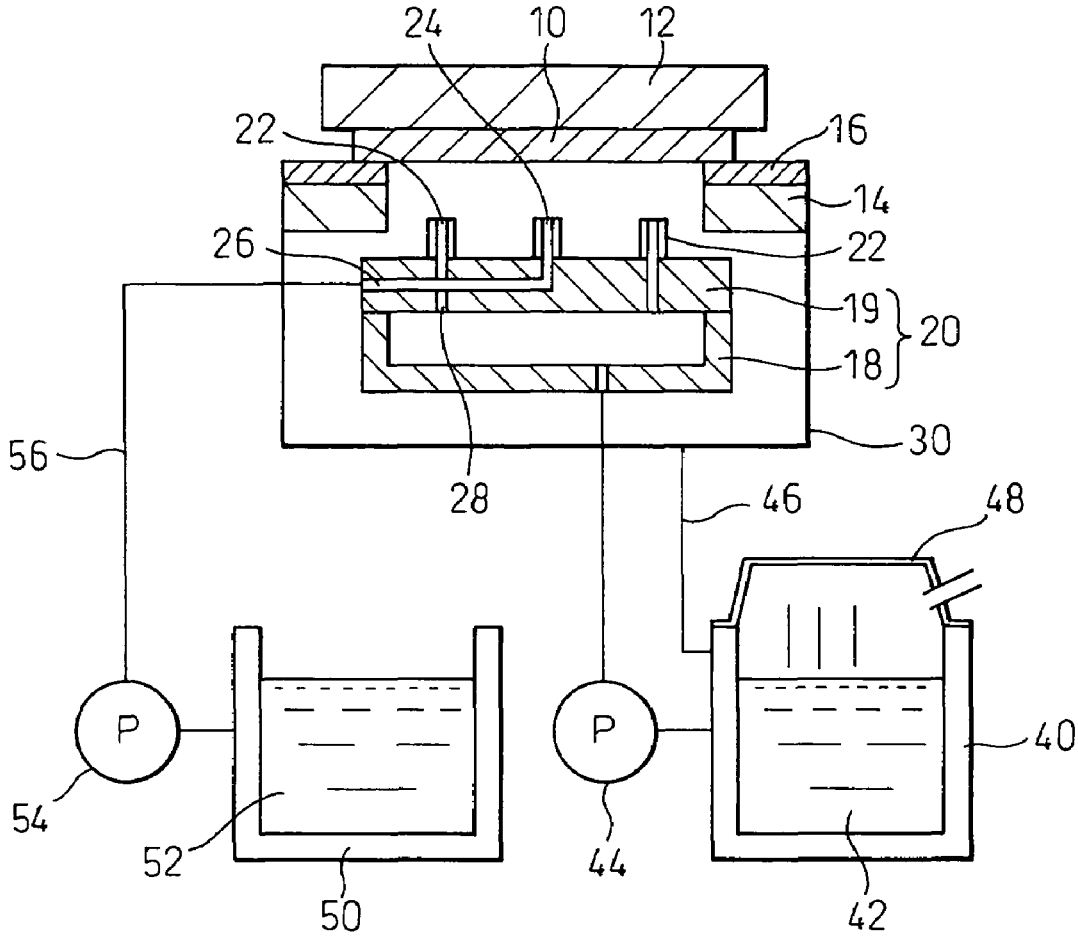
FIG. 1 is a schematic illustration showing an overall structure of an embodiment of the plating processing device of the present invention.

FIG. 1 is a schematic illustration showing an overall structure of an embodiment of the plating processing device of the present invention. In the plating processing device of this embodiment, plating is conducted on an object to be plated in such a manner that a plating solution is jetted out to the object to be plated such as a rectangular or elongated lead frame, a rectangular resin wiring board or semiconductor wafer. The object 10 to be plated is arranged on an upper portion of the plating bath 30. When a plating solution is jetted out from the sparger 20, which is arranged in the plating bath 30, to the object 10 to be plated, plating is conducted on the object 10 to be plated.

Reference numeral 40 is a plating solution tank. The plating solution 42 stored in the plating solution tank 40 is supplied to the sparger 20 by the pump 44 and jetted out from the sparger 20 to the object 10 to be plated.

The object 10 to be plated is arranged at an opening portion, which is provided in the upper portion of the plating bath 30, so that the object 10 is interposed between the backing plate 12 and the mask 14. Due to the above arrangement, the plating bath 30 can be formed into a closed space. Therefore, it becomes possible to jet out the plating solution to the object 10 to be plated so as to conduct plating.

The backing plate 12 shields a reverse face of the object 10 to be plated. In a portion where the mask 14 comes into contact with the object 10 to be plated, the seal 16 is provided in such a manner that the seal 16 surrounds a region of the object 10 to be plated. The inside region of the object 10 surrounded by the seal 16 is the region to be plated. The plating solution can be prevented, by the seal 16, from leaking outside the region to be plated. Therefore, a redundant portion of the object 10 to be plated is prevented from being plated.

In the case of plating a rectangular lead frame in which the unit lead frames are continuously connected to each other, sealing is conducted for each unit lead frame, which is set as a single plating region to be plated, and plating is conducted in each plating region.

The sparger 20 includes: a box portion 18 in which the plating solution 42 supplied from the plating solution tank 40 is accommodated; and a nozzle plate 19 arranged being connected to the box portion 18. The nozzle plate 19 includes: plating nozzles 22 used for plating so that the plating solution can be jetted out from the nozzles 22 to the region to be plated of the object 10; and washing nozzles 24 for washing the object 10 to be plated by jetting out a washing solution to the object 10 to be plated. The box portion 18 is communicated with only the plating nozzles 22 for plating, and the plating solution 42 is jetted out from the plating nozzles 22 at a predetermined pressure.

The plating solution tank 40 is communicated with the box portion 18 of the sparger 20, and the plating solution 42 sent out to the sparger 20 by the pump 44 is jetted out from each nozzle 22 toward the object 10 to be plated so that the pressure of the plating solution 42 can be increased in the box portion 18.

The plating bath 30 is connected to the plating solution tank 40 via the pipe 46, and the used plating solution accumulated in the plating bath 30 is recovered to the plating solution tank 40.

As described above, the plating solution 42 is supplied from the plating solution tank 40 to the sparger 20 and jetted out from the sparger 20 at a predetermined pressure so that the object 10 to be plated can be plated. This method is commonly used, that is, the constitution of this method is not the characteristic part of the present embodiment.

The characteristic constitution of the present embodiment is described as follows. The washing nozzles 24 used for washing the object 10, which has already been plated, are provided in the sparger 20 differently from the plating nozzles 22 for plating the object 10 to be plated, and the washing nozzles 24 and the washing solution tank 50 are communicated with each other via a passage independent from the passage for supplying the plating solution.

In FIG. 1, reference numeral 50 is a washing solution tank for storing the washing solution such as pure water, reference numeral 54 is a pump for supplying the washing solution 52 to the nozzles 24 at a predetermined pressure, and reference numeral 56 is a pipe for connecting the sparger 20 to the washing solution tank 50.

In this embodiment, in order to make the passage for the washing solution 52, which is supplied to the washing nozzles 24, independent from the passage for the plating solution 42 which is supplied to the plating nozzles 22, the passage 26, in which the washing solution 52 flows, and the passage 28, in which the plating solution 42 flows, are formed separately from each other, and the washing nozzles 24 and the plating nozzles 22 are communicated with the washing solution tank 50 and the plating solution tank 40, respectively, via different passages.

Figure 2:
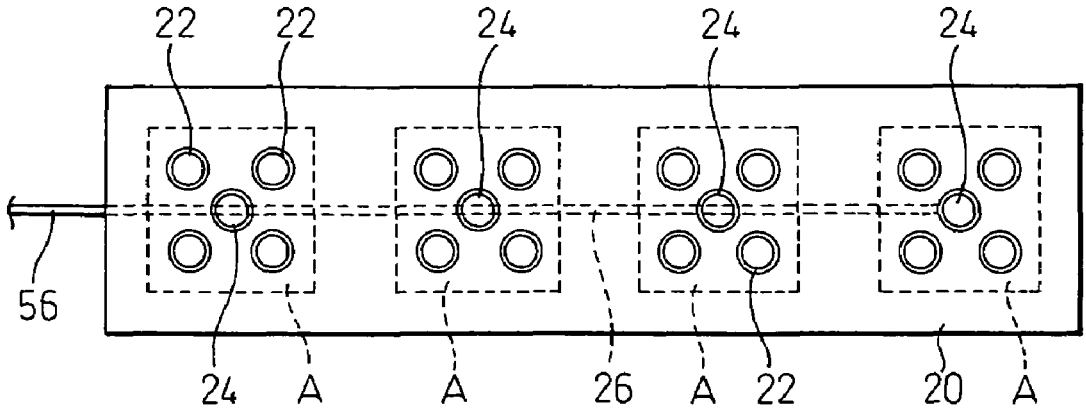
FIG. 2 is a schematic illustration showing an example of the plane arrangement of a nozzle plate.

FIG. 2 is a view showing an example in which the plating nozzles 22 and the washing nozzles 24 are arranged on the nozzle plate 19. In the example shown in the drawing, the object 10 to be plated has a plurality of regions to be plated. Portion A in the drawing is a region to be plated. There are provided four regions A to be plated, which are arranged being divided in the longitudinal direction, on the nozzle plate 19. In each region to be plated, the plating nozzles 22 and the washing nozzle 24 are provided. The washing nozzle 24 is arranged at the center being surrounded by four plating nozzles 22. The washing nozzle 24 is connected to the pipe 56 via the passage 26 without crossing the plating nozzles 22.

Figure 3:
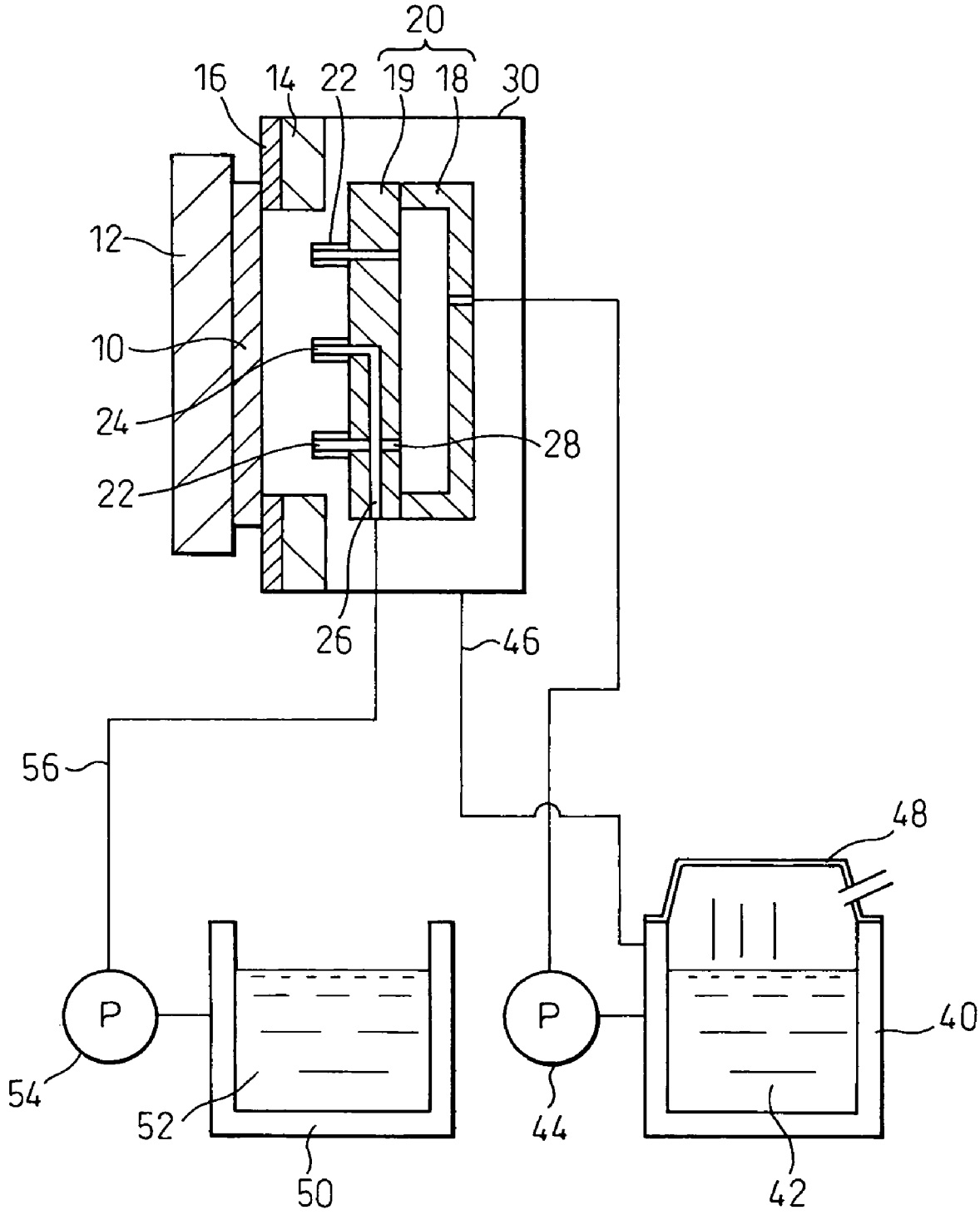
FIG. 3 is a schematic illustration showing an overall structure of another embodiment of the plating processing device of the present invention.

FIG. 3 is a schematic illustration showing an overall structure of another embodiment of the plating processing device of the present invention. In the embodiment shown in FIG. 1, the object to be plated, such as a lead frame or a semiconductor wafer, is horizontally arranged and, therefore, the plating nozzles 22 and washing nozzles 24 are also horizontally arranged so that the plating solution and washing solution are jetted upward to the object 10.

However, in the embodiment shown in FIG. 3, the object to be plated is vertically arranged and, therefore, the plating nozzles 22 and washing nozzles 24 are also vertically arranged so that the plating solution and washing solution are jetted laterally to the object 10. In this embodiment, the same or similar nozzle plate 19 used in the previous embodiment can also be used, although the nozzle plate 19 is vertically arranged.

Figure 4:
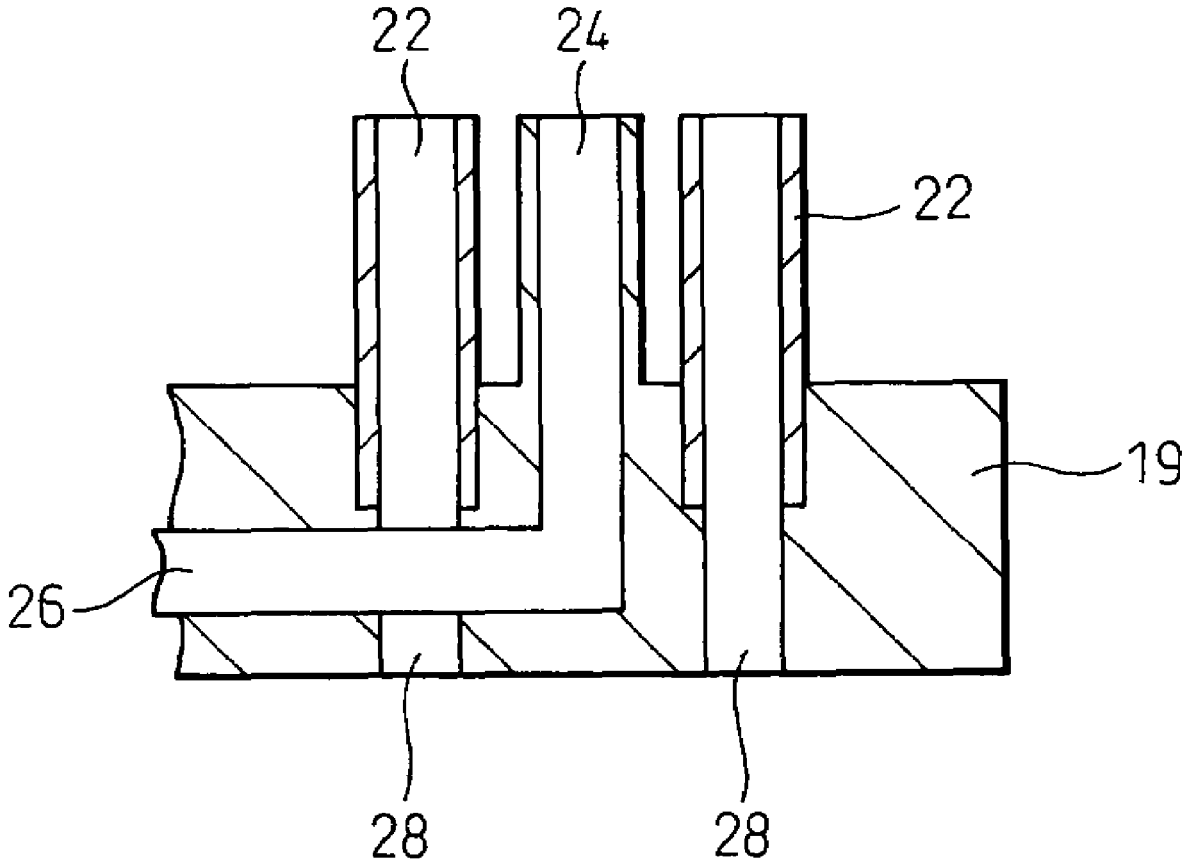
FIG. 4 is a cross-sectional view showing an internal structure of the nozzle plate.

FIG. 4 is an enlarged view showing a passage formed inside the nozzle plate 19. The plating nozzles 22 and the washing nozzle 24 are provided being protruded from the nozzle plate 19. The washing nozzle 24 is communicated with the passage 26 provided inside the nozzle plate 19, and the plating nozzles 22 are communicated with the passage 28 penetrating the nozzle plate 19 in the thickness direction. The passages 26 and 28 are provided in such a manner that they do not cross each other inside the nozzle plate 19.

The box portion 18 is connected to a face on the opposite side to the face of the nozzle plate 19 which is opposed to the object 10 to be plated, and the plating solution 42 is supplied into the box portion 18 from the plating solution tank 40. The passage 28 is communicated with the box portion 18, and the plating solution supplied to the box portion 18 is jetted out from the plating nozzles 22.

On the other hand, the washing nozzle 24 is communicated with the washing solution tank 50 via the passage 26, and the washing solution 52 is supplied via the passage 26 to the washing nozzle 24.

Plating is conducted by the plating processing device of this embodiment as follows. First, the object 10 to be plated is put on the mask 14. After the object 10 to be plated has been secured by the backing plate 12, the pump 44 is operated so that the plating solution 42 is supplied from the plating solution tank 40 to the sparger 20, and the plating solution 42 is jetted out from the plating nozzles 22 to the object 10 to be plated so as to conduct plating. In this case, this plating may be either electrolytic plating or electroless plating.

After the completion of plating of the object 10 to be plated, the pump 44 is stopped. Next, the pump 54 is operated, and the washing solution 52 is jetted out from the washing nozzle 24, which is provided on the nozzle plate 19, to the object 10 to be plated.

After the object 10 having been plated is washed, the object 10 is conveyed out from the mask 14. Then, the next object 10 to be plated is put on the mask 14 and plated and washed. In this way, the object 10 to be plated is successively plated and washed.

The plating solution, which has been jetted out from the plating nozzles 22 in the case of plating the object 10 to be plated, stays in the plating bath 30, and the washing solution, which has been jetted out from the washing nozzle 24 in the case of washing the object 10 to be plated, also stays in the plating bath 30. The plating solution and the washing solution, which have accumulated in the plating bath 30, are recovered into the plating solution tank 40 via the pipe 46.

The plating solution recovered into the plating solution tank 40 is recycled. However, in the case where the washing solution accumulating in the plating bath 30 is recovered into the plating solution tank 40, the washing solution gradually flows into the plating solution tank 40, and there is a possibility that the concentration of the plating solution 42 is decreased.

However, in the case of a plating device actually used, the plating solution is seldom used at the ordinary temperature. In many cases, a heating means such as a heater is provided in the plating solution tank 40 and plating is conducted while the plating solution is being heated. In the case where a contaminated substance is contained in the plating solution, as shown in FIG. 1, the lid 48 is put on the plating solution tank 40. When the plating solution is heated and the tank is tightly closed as described above, a considerably large quantity of water is evaporated and scattered from the plating solution tank 40.

Accordingly, even if both the plating solution and the washing solution accumulating in the plating bath 30 are recovered into the plating solution tank 40, there is no possibility that the composition of the plating solution 42 is immediately changed. Of course, a plating operation can be conducted without putting the lid 48 on the plating solution tank 40.

In the case of the plating device that is used while the plating solution 42 is being heated, when a quantity of the washing solution, which has been used for washing the object 10 to be washed and recovered into the washing solution tank 40, and a quantity of water, which is evaporated and scattered from the plating solution tank 40, are balanced to each other, plating operation can be performed without causing any problems by the method in which both the plating solution and the washing solution are recovered into the plating solution tank 40.

In the case where a quantity of washing solution recovered into the plating solution tank 40 and a quantity of water evaporated from the plating solution tank 40 are not balanced to each other, the quantity of washing solution recovered into the plating solution tank 40 may be adjusted. In the case where the concentration of the plating solution is raised, the washing solution is added into the plating solution tank 40. In this way, the plating solution may be adjusted.

In this connection, a predetermined liquid such as pure water can be used as the washing solution 52. In the case of using pure water as the washing solution 52, even when the washing solution 52, which has been used for washing the object 10 to be plated, is recovered into the plating solution tank 40, only water is added into the plating solution tank 40. Therefore, no problems are caused in the composition of the plating solution. It is also possible to use an acid or an alkali as the washing solution 52. In this case, when the neutralization processing is previously executed in the case of recovering the washing solution into the plating solution tank 40, the plating solution cannot be affected.

According to the plating processing device of this embodiment, the plating nozzles 22 and the washing nozzle 24 are provided in the sparger 20, and both the plating process, in which the object 10 to be plated is plated, and the washing process, in which the object 10 to be plated is washed, can be conducted in the same plating bath 30. Therefore, it is unnecessary to conduct the conveyance work in which the object 10 to be plated is conveyed into the washing tank 50 after the plating of the object 10 to be plated has been completed. Accordingly, plating and washing can be effectively executed. As the object 10 to be plated is washed immediately after the completion of plating, the object 10 to be plated can be effectively washed and the recovery effect of the plating solution can be enhanced. As the plating solution and the washing solution are recovered from the same plating bath 30 into the plating solution tank 40, the plating solution can be recycled as it is. Therefore, it is unnecessary to provide a specific device for recovery and to conduct a recovery operation.

In this embodiment, the plating nozzles 22 and the washing nozzle 24 are arranged differently from each other on the nozzle plate 19, and the passages 26, 28 of the washing solution and the plating solution are differently provided in the nozzle plate 19. In the case of jetting the plating solution and the washing solution to the object 10 to be plated, the solutions are respectively supplied from the independent passages 26, 28 and not mixed with each other. Therefore, the washing effect by the washing solution can be enhanced, and the plating solution adhering to the object 10 to be plated can be highly effectively recovered. Therefore, it is possible to effectively avoid the occurrence of a bad influence on a product which is caused when the plating solution remains on the object 10. As the new washing solution 52 can be jetted out from the washing solution tank 50 to the object 10 at all times and the object 10 having been plated can be washed with the new washing solution 52, the washing effect by the washing solution can be enhanced, and washing can be stably performed and the fluctuation of product quality can be suppressed.

As the washing nozzle 24 is arranged on the nozzle plate 19 according to the plating region of the object 10 to be plated, the washing solution 52 can be jetted out while the washing solution 52 is being concentrated in the plating region of the object 10, and the object 10 can be more effectively washed. Therefore, the object 10 having been plated can be washed while a quantity of the washing solution 52 is reduced. Due to the foregoing, a quantity of the washing solution 52 to be discharged into the plating solution tank 40 can be suppressed. Therefore, the plating solution 42 stored in the plating solution tank 40 can be seldom affected by the discharged washing solution 52 discharged into the plating solution tank 40.

In this connection, the box portion 18 of the sparger 20 is used for various products in common, however, the nozzle plate 19 is used being exchanged for every product because the plating region is different for each product. Accordingly, the nozzle plate 19 should be manufactured, in such a manner that the plating nozzles 22, the washing nozzle 24 and the passages 26, 28 are provided according to the region to be plated of the product. Thus, the nozzle plate 19 can be exchanged in the case of changing the product, and therefore the aforementioned plating operation and washing operation can be performed.

As described above, according to the plating processing device of the present invention, the plating nozzles and the washing nozzle are provided in the sparger, and the passage communicating with the plating nozzles and the passage communicating with the washing nozzle are formed differently from each other. Therefore, the object having been plated can be effectively washed with the washing solution. The plating bath and the plating solution tank are communicated with each other, and the plating solution and the washing solution staying in the plating bath are recovered into the plating solution tank. Due to the above constitution, the plating solution can be easily recovered and recycled. In this way, the present invention can provide a remarkably good effect when a plating process is performed.

It should be understood by those skilled in the art that the foregoing description relates to only some of the preferred embodiments of the disclosed invention, and that various changes and modifications may be made to the invention without departing the sprit and scope thereof.

The invention claimed is:

1. A plating processing device, comprising:

a plating bath having an opening, on which an object to be plated is mounted to close the opening;

a sparger disposed in the plating bath, provided with a plating nozzle and a washing nozzle to jet plating solution and washing solution, respectively, toward the object such that the used plating solution and washing solution are accumulated and collected in the plating bath;

a unit supplying plating solution to the plating nozzle from a plating solution tank;

a unit supplying washing solution to the washing nozzle from a washing solution tank;

a unit recovering the used plating solution and the used washing solution, accumulated in the plating bath, to the plating solution tank; and the sparger further comprising:

a nozzle plate supporting the plating nozzle and the washing nozzle;

a plating solution box attached to the nozzle plate at a side thereof opposite to the object, the plating solution box communicating with the plating solution supplying unit; and the nozzle plate provided with a first passage connected at one end thereof to the plating nozzle and opened at the other end thereof to an interior of the plating solution box, and a second passage, independent from the first passage, connected at one end thereof to the washing nozzle and at the other end thereof to an interior of the washing solution supplying unit.

2. A plating processing device as set forth in claim 1, wherein the object to be plated is mounted on the plating bath via a mask having a plurality of openings which define plating sections on a surface of the object to be plated; and the sparger comprises:

a nozzle plate for supporting a plurality of plating nozzles and washing nozzles, which are divided into a plurality of groups for the respective plating sections, each group comprising a plurality of plating nozzles and at least one washing nozzle;

a plating solution box attached to the nozzle plate at a side opposite thereof to the object, the plating solution box being communicated with the plating solution supply unit;

the nozzle plate provided with first passages each connected at one end thereof to a respective plating nozzle and opened at the other end thereof to an interior of the plating solution box, and second passages, independent from the first passages, each connected at one end thereof to a respective washing nozzle and at the other end thereof to an interior of the washing solution supply unit.

3. A plating processing device as set forth in claim 2, wherein, in each group, there are at least one washing nozzle and a plurality of plating nozzles arranged dispersedly around the washing nozzle so as to uniformly jet the plating solution toward an area within the respective plating section.

4. A plating processing device as set forth in claim 1, wherein the plating solution tank is provided with a heater for heating the plating solution contained in the plating solution tank to promote an evaporation of the plating solution.

5. A plating processing device as set forth in claim 1, wherein the plating solution tank is provided with an adjuster for adjusting a concentration of the plating solution contained in the plating solution tank.

6. A plating processing device as set forth in claim 5, wherein the adjuster for adjusting a concentration of the plating solution is a lid, which is detachable with respect to the plating solution tank.

* * * * *